United States Patent [19]

Egashira et al.

[11] Patent Number: 5,013,711

[45] Date of Patent: May 7, 1991

[54] IMAGE-RECEIVING SHEET

[75] Inventors: Noritaka Egashira; Kenichiro Suto; Atsushi Muro, all of Shinjuku, Japan

[73] Assignee: Dai Nippon Insatsu Kabushiki Kaisha, Tokyo, Japan

[21] Appl. No.: 490,422

[22] Filed: Mar. 8, 1990

Related U.S. Application Data

[62] Division of Ser. No. 268,987, Nov. 9, 1988, Pat. No. 4,929,591.

[30] Foreign Application Priority Data

Nov. 13, 1987 [JP] Japan ..... 62-2865743
Oct. 24, 1988 [JP] Japan ..... 63-26624

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

U.S. PATENT DOCUMENTS 4,855,281 8/1989 Byers ..... 503/227
4,908,345 3/1990 Egashira et al. ..... 503/227

OTHER PUBLICATIONS

"Photodegradation and Stabilization of Polymers," pp. 270–277, (1986).

*Primary Examiner*—Bruce H. Hess
*Attorney, Agent, or Firm*—Parkhurst, Wendel & Rossi

[57] ABSTRACT

The image-receiving sheet of the present invention is used in combination with a heat transfer sheet having a colorant layer containing a sublimable dye on one surface of a substrate sheet. The image-receiving sheet includes a receiving layer containing a synthetic resin and an antioxidant including a specific structure as described above for receiving the sublimable dye migrated from the colorant layer of the heat transfer sheet formed on one surface of a substrate sheet, and therefore it can give a hard copy having extremely high light resistance of the recorded image of which color will be faded only with difficulty even when stored for a long term.

6 Claims, No Drawings

IMAGE-RECEIVING SHEET

This application is a Rule 60 divisional application of Ser. No. 07/268,987, filed Nov. 9, 1988, now U.S. Pat. No. 4,929,591.

BACKGROUND OF THE INVENTION

This invention relates to image-receiving sheets which are suitable for performing recording by means of dot-shaped heating printing means such as thermal heads, used in combination with a heat transfer sheet having a colorant layer containing a sublimable dye formed thereon, and are excellent in light resistance after recording.

A heat printing system is known in which a dye receivable resin such as thermoplastic polyester resin is laminated as the receiving layer on a substrate sheet, such as paper, and the heat transfer sheet is superposed on the thus prepared image-receiving sheet for effecting heat printing thereby to express gradation of the color depending on the magnitude of imparted heat energy during printing. Further, various hues can be reproduced by a combination of various colors with the use of a plurality of heat transfer papers with different hues during printing, whereby the printed matter in which the same tone as in natural color photography or color printing is expressed can be obtained. The thermal energy for printing can be controlled by electrical signals based on the images recorded by VTR, etc. or projected onto a color cathode-ray tube, and therefore is useful as the system for the so-called "hard copying system" in which these images are taken out as the printed matter. In this case, the thermal heads of the printer are used as the heat printing means, and multiple color dots of 3 colors or 4 colors are transferred by heating within a very short time, whereby the full color image of the original is reproduced with the color dots of said multiple colors.

The color image thus formed is very sharp, because the colorant employed is a dye, and also exhibits excellent transparency, and therefore the image obtained is excellent in reproducibility and tone of the intermediate color, which is similar to the image according to off-set printing or gravure printing, and an image of high quality comparable to full color photographic image can be formed.

However, since the image obtained in the image-receiving sheet of the prior art is formed of a dye, it is generally inferior in light resistance as compared with the image by use of a pigment, and there is involved the problem that the image will be rapidly faded or discolored when exposed directly to sunlight.

For overcoming such drawbacks, there has been proposed an image-receiving sheet comprising a UV-ray absorber or a photostabilizer contained in the receiving layer. As the UV-ray contained in this kind of image-receiving layer, use of, for example, salicylic acid derivatives, benzophenone compounds, benzotriazole compounds and acrylate compounds have been known, while as the photostabilizer, naphthylamine compounds, diphenylamine compounds and phenol compounds have been known.

However, although a considerable effect can be obtained by the addition of these UV-ray absorbers, etc. as compared with the case where no such additive is added, the effect is not yet satisfactory.

Also, the problem of discoloration and fading occurs in other cases than by direct sunlight irradiation. For example, discoloration and fading by indoor light, or discoloration and fading under the state where no direct light such as of the contents of album case or book is irradiated may be generated, and these problems of indoor discoloration and fading or dark fading cannot be solved by use of UV-ray absorbers or antioxidants in general, both remaining as the important tasks to be solved.

SUMMARY OF THE INVENTION

An object of the present invention is to provide an image-receiving sheet which gives a sharp image with sufficient density, and yet forms an image which exhibits excellent various fastness, storability, particularly excellent light resistance, resistance to indoor discoloration and fading and resistance to dark fading, in a heat transfer method by use of a sublimable dye.

DETAILED DESCRIPTION OF THE INVENTION

The image-receiving sheet of the present invention comprises a substrate sheet and a dye receiving layer provided on at least one surface thereof.

As the substrate to be used in the present invention, there can be employed synthetic paper (polyolefin type, polystyrene type, polyester type, etc.), wood free paper, art paper, coated paper, cast coated paper, wall paper, backing paper, synthetic resin or emulsion impregnated paper, synthetic rubber latex impregnated paper, synthetic resin internally added paper, board paper, etc., cellulose fiber paper, various films or sheets of plastics such as of polyolefin, polyvinyl chloride, polyethyleneterephthalate, polystyrene, polymethacrylate, and polycarbonate. It is also possible to use a white opaque film formed by forming a composition of these synthetic resins added with white pigment or filler into a film or a foamed sheet formed by foaming thereof, etc. Thus, the substrate sheet is not particularly limited.

Also, a laminated product by any desired combination of the above substrate sheets can be used. Representative examples of laminated products may include cellulose fiber paper and synthetic paper or cellulose fiber paper, plastic film or sheet and synthetic paper. These substrates may have any desired thickness, for example, generally a thickness of about 10 to 300 $\mu$m.

The substrate sheet as described above should be preferably applied with primer treatment or corona discharging treatment when adhesive force with the receiving layer formed on its surface is poor.

The receiving layer formed on the surface of the above substrate sheet is provided for receiving the sublimable dye migrated from the heat transfer sheet, thereby maintaining the image formed.

As the resin for forming the dye receiving layer, there may be included, for example, polyolefin resins such as polypropylene, halogenated polymers such as polyvinyl chloride, polyvinylidene chloride, vinyl polymers such as polyvinyl acetate, polyacrylic ester, polyester resins such as polyethyleneterephthalate, polybutyleneterephthalate, polystyrene resins, polyamide resins, copolymer resins of olefins such as ethylene, propylene, with other vinyl monomers, ionomers, cellulosic resins such as cellulose diacetate, particularly preferably vinyl resins and polyester resins.

The above resins are summarized below:

(a) those having ester linkage:

polyester resin, polyacrylate resin, polycarbonate resin, polyvinyl acetate resin, styrene-acrylate resin, vinyl toluene-acrylate resin, etc.;

(b) those having urethane linkage: polyurethane, etc.;

(c) those having amide linkage: polyamide resin, etc.;

(d) those having urea linkage: urea resin, etc.;

(e) those having other linkages of high polarity: polycaprolactone resin, styrene-maleic anhydride resin, polyvinyl chloride resin, polyacrylonitrile resin, etc.

In addition to the synthetic resins as mentioned above, mixtures or copolymers of these can also be used.

In the present invention, the receiving layer can be also formed of two kinds of resins with different properties. For example, the first region of the receiving layer can be formed of a synthetic resin having a glass transition temperature of −100 to 20° C. and also a polar group, while the second region of the receiving layer can be formed of a synthetic resin having a glass transition temperature of 40° C. or higher. The first region and the second region are both exposed on the surface, with the first region comprising 15% or more of said surface, the first region existing in shape of islands independently of each other, with the length of each island portion in the longer direction being preferably 0.5 to 200 μm.

Also, in the present invention, the receiving layer can be formed to contain fine powder of silica in addition to the resin as described above. Here, silica refers to silicon dioxide or a substance composed mainly of silicon dioxde. As the fine powdery silica to be contained in the receiving layer, one having an average particle size of 0.5 to 30 μm and a specific surface area less than 250 $m^2/g$, more preferably an average particle size of 1 to 5 μm and a specific surface area of 20 to 200 $m^2/g$, may be used.

If the average particle size of fine powdery silica is larger than this range, dispersing stability of fine powdery silica in the coating composition for receiving layer to be used for formation of the receiving layer will be lowered, and also smoothness of the receiving layer surface of the image-receiving sheet remarkably impaired, whereby the image obtained by heat transfer becomes indistinct. On the other hand, if the average particle size of fine powdery silica is smaller than this range, fluidity of the coating composition for receiving layer to be used for formation of receiving layer will be lowered, and also the effect of addition of fine powdery silica to the image-receiving sheet is not fully exhibited.

Specific examples of fine powdery silica satisfying such conditions may include AEROSIL R972, AEROSIL 130, AEROSIL 200, AEROSIL OX50, AEROSIL TT600, AEROSIL MOX80, AEROSIL MOX170 (silica powders produced by 'Aerosil K.K., Japan).

The content of fine powdery silica may be in the range of from 5 to 20% by weight, more preferably from 5 to 10% by weight, based on the weight of the receiving layer.

These fine powdery silicas may be previously added into the resin for forming the receiving layer and the resultant resin mixture solution is coated and dried on a substrate to form a receiving layer.

In forming the receiving layer, various additives other than the above fine powdery silica can be added, and those components should be selected from those which will not interfere with fixing of the dye migrated from the heat transfer sheet during heating.

In the present invention, at least one compound represented by the following formula is included in the resin for formation of the receiving layer as described above:

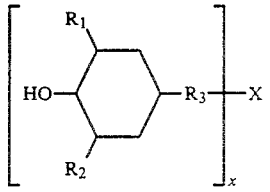

wherein $R_1 = C_lH_{2l+1}$ ($l \geqq 0$), $R_2 = C_mH_{2m+1}$ ($m \geqq 0$), $R_3$ is an atomic group comprising carbon atoms ($C_\eta$) as the main skeleton ($n \geqq 4$), X is a hydrogen atom, sulfur atom, carbon atom or null, and x is an integer from 1 to 4.

More specifically, at one of the compounds shown below is included in the resin for formation of the receiving layer as described above:

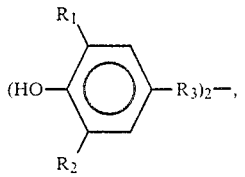

(I)

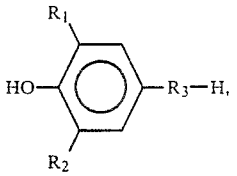

(II)

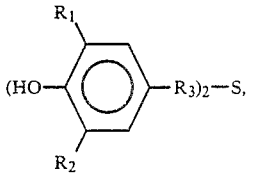

(III)

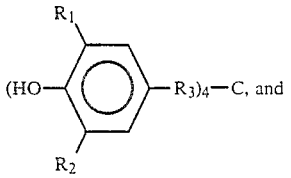

(IV)

-continued

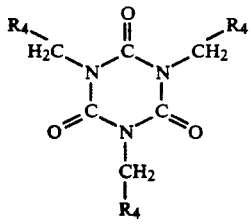

(V)

wherein $R_1 = C_lH_{2l+1}$ ($l \geqq 0$), $R_2 = C_mH_{2m+1}$ ($m \geqq 0$), $R_3$ is an atomic group comprising carbons ($C_n$) as the main skeleton ($n \geqq 4$), and $R_4$ is:

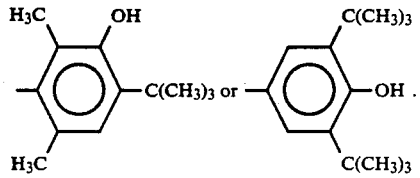

First, specific examples of the compounds comprising the structures (I), (II), (III) and (IV) as mentioned above (antioxidant) are shown below.

As the antioxidant having a structure comprising an atomic group with $C_nH_{2n}$ as the main skeleton, for example, 1-(3,5-dibutyl-4-hydroxyphenyl)butane:

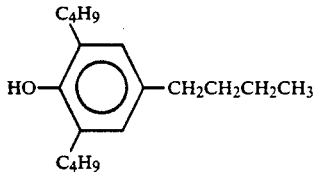

may be included, while as the antioxidant comprising a structure having at least one of the group consisting of:

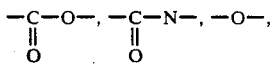

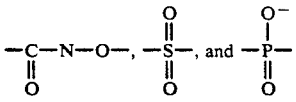

inserted in a part of $R_3$ comprising an atomic group with $C_nH_2$, for example, triethyleneglycol-bis[3-(3-butyl-4-hydroxyphenyl)-propionate]:

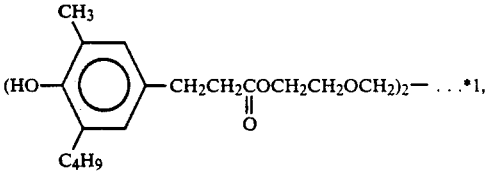

1,6-hexanediol-bis[3-butyl-5-methyl-4-hydroxyphenyl)-propionate]:

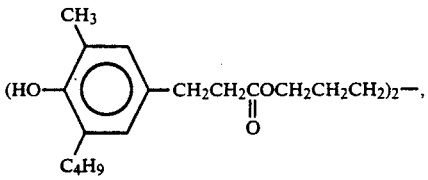

N,N'-hexamethylene-bis(3,5-dibutyl-4-hydroxy-hydrocinnamide):

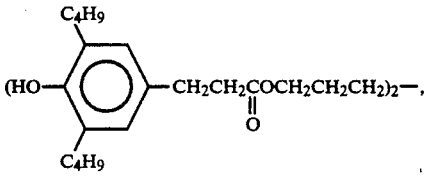

2,2-thio-diethylene-bis[3-(3,5-dibutyl-4-hydroxy-phenyl)-pripionate]:

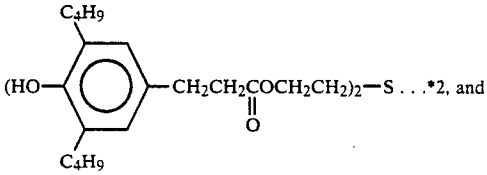

octadecyl-3-(3,5-dibutyl-4hydroxyphenyl)propionate:

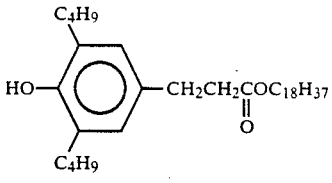

may be included.

In the present invention, together with the above antioxidant, photostabilizer and/or UV-ray absorber can be used in combination to be contained in the receiving layer. As the photostabilizer, for example, one having the following structure can be used:

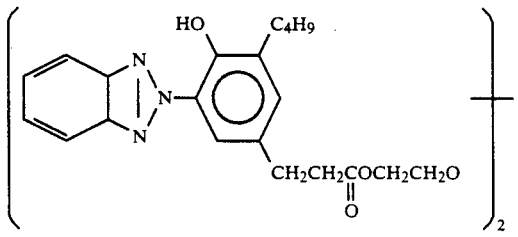

As the UV-ray absorber, for example, one having the following structure can be used:

2-(5-methyl-2-hydroxyphenyl)benzotriazole:

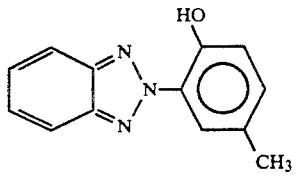

The above antioxidant can be contained in an amount of 0.05 to 10 parts by weight based on 100 parts by weight of the resin in the receiving layer, while the photostabilizer and the UV-ray absorber when used in combination with the antioxidant can be both contained in an amount of 0.05 to 10 parts by weight on the same basis. Thus, by containing the antioxidant comprising the constitution as described above, light resistance of the recorded image on the receiving layer can be improved without affecting appearance, surface state of the receiving layer and dyeability of the dye. If either one of the contents exceeds the upper limit, no improvement of light resistance can be seen, while if it is less than the lower limit, no light resistance can be exhibited.

Also, in the present invention, by including the above compound (V) in the receiving layer of the image-receiving sheet, there can be provided an image receiving sheet which gives a sharp image with sufficient density and yet forms an image which exhibits excellent various fastness, particularly excellent resistance to indoor discoloration and fading and resistance to dark place discoloration and fading, in a heat transfer method by use of a sublimable dye.

The antioxidant of the formula wherein R is:

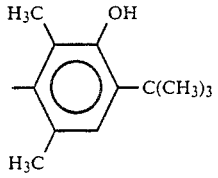

is 1,3,5-tris(4-tert-butyl-3-hydroxy-2,6-dimethylbenzyl)-isocyanurate and is available as the trade name of, for example, CYANOX-1790 (produced by Sunchemical Co., Japan), while the antioxidant of the above formula wherein R is:

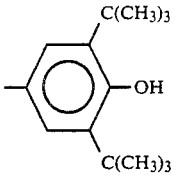

is 1,3,5-tris(3,5-di-tert-butyl-4-hydroxy-benzyl)-isocyanurate and is available as the trade name of, .for example, IRGANOX-3114 (produced by Ciba-Geigy Co.), and can be used in the present invention.

These antioxidants can be used either alone or as a mixture, and further other UV-ray absorbers or antioxidants can be also used in combination.

The amount of the antioxidant of the above formula (V) used is not particularly limited, but it may be used in an amount of 0.5 to 10 parts by weight, preferably 3 to 10 parts by weight, based on 100 parts by weight of the resin forming the dye receiving layer. If the amount used is too small, the desired effect of the present invention can be obtained with difficulty, while too much amount is uneconomical.

The dye receiving layer formed as described above may have any desired thickness, but generally a thickness of 1 to 50 μm. Such dye receiving layer may be preferably a continuous coating, but also noncontinuous coatings may be formed by use of a resin emulsion or a resin dispersion.

In the present invention, only the antioxidant may be singly contained in the receiving layer, but when photostabilizer and/or UV-absorber is contained in combination, light resistance can be further improved as compared with the case when only the above antioxidant is contained. Hence, when the demand for light resistance is high, it is preferable to use them in combination, and for the respective contents when used in combination the above contents shown for the respective contents may be applicable as such. Among the above components, photostatilizer may be considered to prevent fading by trapping the radicals of the dye formed in the receiving layer by light.

The above antioxidant, photostabilizer and UV-ray absorber can be contained in the receiving layer by adding them into a coating composition for formation of receiving layer to be dispersed or dissolved therein, and coating the dispersion or solution onto a substrate sheet, followed by drying.

Also, the image-receiving sheet of the present invention can contain a mold release agent in the receiving layer for improving releasability from the heat transfer sheet. As the mold release agent, solid waxes such as polyethylene wax, amide wax, Teflon powder; surfactants such as fluorine type, phosphate type; and silicone oils may be included, preferably silicone oils are used.

As the above silicone oil, although oily ones can be used, cured type oils are preferred. Examples of the cured type silicone oil may include the reaction cured type, the photocured type, the catalyst cured type, etc., preferably silicone oils of the reaction cured type. As the reaction cured type silicone oil, those obtained by the reaction curing of amino-modified silicone oil and epoxy-modified silicone oil may be employed. As the amino-modified silicone oil, KF-393 (produced by Shinetsu Kagaku Kogyo K.K., Japan) may be employed, and as the epoxy-modified silicone oil, X-22-343 (produced by Shinetsu Kagaku Kogyo K. K., Japan) may be employed. As the catalyst cured type or photocured type silicone oil, KS-705F-PS (catalyst cured type silicone oil, produced by Shinetsu Kagaku Kogyo K.K., Japan), KS-720 (photocured type silicone oil, produced by Shinetsu Kagaku Kogyo K.K., Japan) can be employed. The amount of these cured type silicone oils added may be preferably about 0.5 to 30 parts by weight based on 100 parts by weight of the resin constituting the receiving layer.

It is also possible to provide a mold release agent layer by coating at least a part of the surface of the receiving layer with a solution or dispersion of the above mold release agent, followed by drying. As the mold release agent constituting the mold release agent layer, the reaction cured product of the amino-modified silicone oil and the epoxy-modified silicone oil as described above is particularly preferred. The thickness of the mold release agent layer may be preferably 0.01 to 5 μm, particularly 0.02 to 2 μm. Although the mold release agent layer may be provided either on a part of the receiving layer surface or on the whole surface thereof, when it is provided on a part of the receiving layer, recording can be performed by dot impact printing, heat-sensitive melt transfer recording, or a pencil at the portion where no mold release agent is provided, and sublimation transfer recording is performed at the portion where the mold release agent layer is provided while performing recording according to other recording systems on the portion while no mold release agent layer is provided. Thus, the sublimation transfer recording system can be performed in combination with other recording systems.

The image-receiving sheet of the present invention can also have a cushioning layer provided between the substrate sheet and the receiving layer. By provision of a cushioning layer, noise is reduced, whereby images corresponding to image information can be transfer recorded with good reproducibility. As the material for constituting the cushioning layer, for example, urethane resin, acrylic resin, ethylene resin, butandiene rubber, and epoxy resin, may be employed. The cushioning layer may have a thickness preferably of about 2 to 20 μm.

The substrate sheet can also have a lubricating layer provided on the back thereof. The image-receiving layers may be in some cases piled on one another and delivered one by one for effecting transfer thereon, and when a lubricating layer is provided in this case, sliding mutually between the sheets become smooth, whereby each of the sheets can be accurately delivered. As the material for the lubricating layer, methacrylate resin such as methyl methacrylate or corresponding acrylate resin, and a vinyl resin such as vinyl chloride-vinyl acetate copolymer can be employed.

Also, an antistatic agent can be incorporated in the image-receiving sheet. By incorporating an antistatic agent, there is the effect of preventing attachment of dust on the image-receiving sheet. The antistatic agent may be contained in the substrate sheet or the receiving layer, or it can be also provided as the antistatic agent layer on the back of the substrate sheet or on the receiving layer, but it is preferably provided as the antistatic layer on the back of the substrate sheet.

It is also possible in the present invention to provide a detection mark on the image-receiving sheet. The detection mark is very convenient for performing registration between the heat transfer sheet and the image-receiving sheet, and, for example, can be provided by printing a detection mark detectable by a photoelectric tube detecting device on the back of the substrate.

The present invention is described in more detail by referring to Examples.

EXAMPLE A-1

Preparation of heat transfer sheet

By use of a polyethyleneterephthalate sheet with a thickness of 6 μm (S-PET) applied with corona treatment on one surface as the support, on the corona treated surface of the film, a coating composition for colorant layer having a composition shown below was formed by wire 7 bar coating to a thickness of 1 μm on drying, followed by the back treatment coating by applying one or two drops of a silicone oil (produced by Shinetsu Silicone, Japan: X-41-4003A) with a squirt and spreading it over the whole surface, to prepare a heat transfer sheet.

Coatinq composition for colorant layer

| | |
|---|---|
| Disperse dye (produced by Nippon Kayaku, Japan: Kayaset Blue 714) | 4 parts by wt. |
| Ethylhydroxyethyl cellulose (produced by Hercules) | 5 parts by wt. |
| Toluene | 40 parts by wt. |
| Methyl ethyl ketone | 40 parts by wt. |
| Dioxane | 10 parts by wt. |

Preparation of image-receiving sheet

By use of a synthetic paper with a thickness of 150 μm (produced by Oji Yuka, Japan: YUPO-FPG-150) as the substrate sheet, a coating composition for receiving layer having a composition shown below was applied on the surface by wire bar coating to form an image-receiving sheet with a thickness of 10 μm on drying. Drying was performed after tentative drying by a dryer in an oven of a temperature of 100° C. for 30 minutes.

| | |
|---|---|
| Polyester resin (produced by Toyobo, Japan: Vylon 600) | 5.4 parts by wt. |
| Polyvinyl chloride-vinyl acetate resin (produced by Denki Kagaku: Denkavinyl #1000A) | 8.0 parts by wt. |
| Amino-modified silicone oil (produced by Shinetsu Kagaku, Japan: KF-393) | 0.25 part by wt. |
| Epoxy-modified silicone oil (produced by Shinetsu Kagaku, Japan: X-22-343) | 0.25 part by wt. |
| Antioxidant (produced by Ciba-Geigy: IRGANOX-245) | 1.3 parts by wt. |
| Toluene | 42.4 parts by wt. |
| Methyl ethyl ketone | 42.4 parts by wt. |

The above antioxidant has a structure represented by the structural formula *1 in the above specific examples.

The heat transfer sheet and the image-receiving sheet obtained as described above were superposed so that the colorant layer contacted the receiving layer and printing was carried from the support side of the heat transfer sheet by use of a thermal head under the conditions of an output of the thermal head of 1 W/dot, a pulse width of 0.3 to 0.45 msec and a dot density of 3 dots/mm to dye image wise a dye of magenta color on the receiving layer of the image-receiving sheet.

When the recorded image-receiving sheet was exposed for 3.5 hours based on JIS L0842, the fading ratio of the image was 15%.

EXAMPLE A-2

An image-receiving sheet was obtained in the same manner as in Example A-1 except for using a composition (B) in which the antioxidant in the composition (A) used in Example A-1 was replaced with an antioxidant produced by Ciba-Geigy: IRGANOX-1035 (this antioxidant has a structural formula represented by the structural formula *2 in the above specific examples) as the coating composition for receiving layer.

By use of the image-receiving sheet obtained with the same heat transfer sheet as in Example A-1, transfer was effected according to the same method. As the result, the fading ratio of the recorded image-receiving sheet was 17%.

EXAMPLE A-3

An image-receiving sheet was obtained in the same manner as in Example A-1 except for using a composition (C) in which 1.3 parts by weight of a photostabilizer (produced by Ciba-Geigy: TINUVIN-1130) were further included in the composition (A) used in Example A-1 as the coating composition for receiving layer. By use of the image-receiving sheet obtained with the same heat transfer sheet as in Example A-1, transfer was effected according to the same method. As the result, the fading ratio of the recorded image-receiving sheet was 5%, thus exhibiting the effect of combined use.

COMPARATIVE EXAMPLE A-1

An image-receiving sheet was obtained in the same manner as in Example A-1 except for using 1.3 parts by weight of a conventional hindered phenol type antioxidant (produced by Ciba-Geigy: IRGANOX-1076) and 1.3 parts by weight of a benzotriazole type photostabilizer (produced by Ciba-Geigy: TINUVIN-328) in place of the antioxidant used in Example A-1.

By use of the image-receiving sheet with the same heat transfer sheet as in Example A-1, transfer was effected according to the same method. The fading ratio of the recorded image-receiving sheet was measured similarly as in Example A-1 to be 35%.

Here, for supporting good light resistance of the image-receiving sheet of the present invention, the results of fading ratio of the transferred images with the image-receiving sheets prepared under various embodiments are shown below in the Table for the purpose of reference.

More specifically, fading ratios of the transferred images with the image-receiving sheets obtained in the respective cases of containing various antioxidants (a) of the present invention, containing various antioxidants in general (b) comprising structures other than the antioxidants in the present invention, and containing none of the above antioxidants (a) and (b) were measured according to the same method as in Example A-1. Also, fading ratios with the image-receiving sheets obtained when using various photostabilizers for the above various embodiments in combination were measured.

For the above antioxidant (a), any of the antioxidants in the present invention can be used, while for the above antioxidant (b) any of those having other structures than the antioxidant of the present invention can be used and, for example, a compound having the following structure was employed:

2,6-dibutyl-4-methylphenol

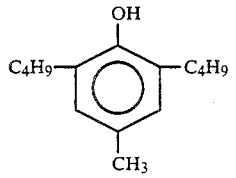

As the photostabilizer, photostabilizers known in the art were used.

The conditions for preparation of the image-receiving sheet, preparation of the heat transfer sheet, transfer recording, etc. followed those in Examples A-1, A-2 and Comparative Example A-1.

TABLE 1

| Antioxidants | Fading Ratio: Photostabilizer (not used) | Fading Ratio: Photostabilizer (used) |
|---|---|---|
| containing the antioxidant (a) in the present invention | 10–20% | 0–10% |
| containing the antioxidant (b) with structure other than the present invention | 40–50% | 30–40% |
| containing none of the antioxidants (a) and (b) | 55% or higher | 50% or higher |

EXAMPLE B-1

By use of a synthetic paper (YUPO FRG-150, thickness 150 μm, produced by Oji Yuka, Japan) as the substrate sheet, a coating solution having a composition shown below was applied by a bar coater on one surface of the sheet at a ratio of 5.0 g/m$^2$ on drying and dried to obtain an image-receiving sheet of the present invention.

| | |
|---|---|
| Polyester (Vylon 600, produced by Toyobo, Japan) | 4.0 parts |
| Vinyl chloride/vinyl acetate copolymer (Denkavinyl #1000A, produced by Denki Kagaku, Japan) | 6.0 parts |
| Amino-modified silicone (X-22-3050C, produced by Shinetsu Kagaku Kogyo, Japan) | 0.2 part |
| Epoxy-modified silicone (X-22-3000E, produced by Shinetsu Kagaku Kogyo, Japan) | 0.2 part |
| Antioxidant (CYANOX-1790, produced by Sunchemical, Japan) | 0.3 part |
| Methyl ethyl ketone/toluene (weight ratio 1/1) | 89.3 parts |

EXAMPLE B-2

An image-receiving sheet of the present invention was obtained in the same manner as in Example B-1 except for using 0.4 part of an ontioxidant (IRGANOX-3114, produced by Ciba-Geigy) in place of the antioxidant in Example B-1 and changing the amount of the solvent to 89.2 parts.

EXAMPLE B-3

An image-receiving sheet of the present invention was obtained in the same manner as in Example B-2 except for using 0.2 part of an antioxidant (CYANOX-1790, produced by Sunchemical, Japan) and 0.2 part of an antioxidant (IRGANOX-3114, produced by Ciba-Geigy) in place of the antioxidant in Example B-2.

COMPARATIVE EXAMPLE B-1

An image-receiving sheet of comparative example was obtained in the same manner as in Example B-1 except for using no antioxidant in Example B-1 and changing the amount of the solvent to 89.6 parts.

COMPARATIVE EXAMPLE B-2

An image-receiving sheet of comparative example was obtained in the same manner as in Example B-1 except for using 0.3 parts of an antioxidant (Sumilizer BHT, produced by Sumitomo Kagaku, Japan) in place of the antioxidant in Example B-1.

COMPARATIVE EXAMPLE B-3

An image-receiving sheet of comparative example was obtained in the same manner as in Example B-1 except for using 0.3 part of an antioxidant (Sumilizer TNP, produced by Sumitomo Kagaku, Japan) in place of the antioxidant in Example B-1.

On the other hand, an ink composition for formation of dye carrying layer having a composition shown below was prepared and coated by a wire bar on a polyethyleneterephthalate film with a thickness of 6 μm applied on the back with heat-resistant treatment to a coated amount on drying of 1.0 g/m$^2$ and dried to obtain a heat transfer sheet.

| | |
|---|---|
| C.I. Disperse Yellow 201 | 5.5 parts |
| Polyvinylbutyral resin (Eslec BX-1, produced by Sekisui Kagaku, Japan) | 4.5 parts |
| Methyl ethyl ketone/toluene (weight ratio 1/1) | 90.0 parts |

The above heat transfer sheet and the image-receiving sheet of the present invention and comparative example were superposed with the respective dye layer and dye receiving surface opposed to each other, and recording was performed from the back of the heat transfer sheet by use of a heat-sensitive sublimating transfer printer (VY-50, produced by Hitachi Seisakusho K.K.) with a printing energy of 90 mJ/mm$^2$. The result is shown in Table 2. Storability of printing was compared by the fading ratio after the recorded image was held at 70° C. under dry state for 24 hours. The fading ratio is a value calculated by the following formula:

$$\text{Fading ratio (\%)} = \frac{O.D._0 - O.D._1}{O.D._0} \times 100$$

$O.D._0$ = Reflective density of printed matter immediately after printing $O.D._1$ = Reflective density of printed matter after storage at 70° C. for 24 hours.

TABLE 2

| Image | Fading ratio |
|---|---|
| Example B-1 | 10.5 |
| Example B-2 | 12.4 |
| Example B-3 | 11.8 |
| Comparative Example B-1 | 32.5 |
| Comparative Example B-2 | 28.2 |
| Comparative Example B-3 | 29.4 |

As described above, the image-receiving sheet of the present invention is used in combination with a heat transfer sheet having a colorant layer containing a sublimable dye on one surface of a substrate sheet, and comprises a receiving layer containing a synthetic resin and an antioxdiant comprising a specific structure as described above for receiving the sublimable dye migrated from the colorant layer of the heat transfer sheet formed on one surface of a substrate sheet, and therefore it can give a hard copy having extremely high light resistance of the recorded image of which color will be faded with difficulty even when stored for a long term. Also according to the present invention when a photostabilizer and/or a UV-ray absorber is used in combination in addition to the above antioxidant, light resistance of the above image is further improved, whereby the effects as described above will occur more remarkably.

What is claimed is:

1. An image-receiving sheet for thermal dye transfer, comprising a substrate sheet and a dye receiving layer formed on at least one surface of said substrate sheet, said dye receiving layer comprising a synthetic resin and at least one anti-oxidant represented by the following formula:

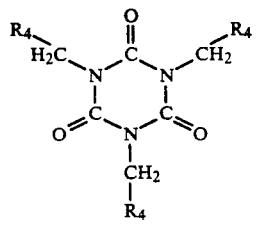

wherein $R_4$ is at least one material selected from the group consisting of

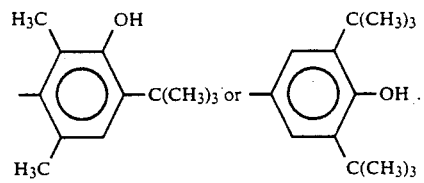

2. An image-receiving sheet according to claim 1, wherein a photostabilizer and/or a UV-ray absorber is further contained in combination in said dye receiving layer.

3. An image-receiving sheet according to claim 1, wherein a mold release layer is provided on a part or whole surface of the dye receiving layer surface.

4. An image-receiving sheet according to claim 1, wherein a cushioning layer is provided between the substrate sheet and the dye receiving layer.

5. An image-receiving sheet according to claim 1, wherein said anti-oxidant is present in an amount of 0.5 to 10 parts by weight per 100 parts by weight of said synthetic resin.

6. An image-receiving sheet according to claim 1, wherein the dye receiving layer further contains a mold release agent.

* * * * *